US007035419B2

(12) United States Patent
Yu et al.

(10) Patent No.: US 7,035,419 B2
(45) Date of Patent: Apr. 25, 2006

(54) ANTI-RESONANT STRUCTURE FOR SPEAKERS

(75) Inventors: Ching-Hsiang Yu, Lujhou (TW); Ming Yeang Lin, Taoyuan (TW); Chin-Fa Liao, Sinjhuang (TW); Chien-Hung Chen, Shulin (TW)

(73) Assignee: Uniwill Computer Corp., Chungi (TW)

( * ) Notice: Subject to any disclaimer, the term of this patent is extended or adjusted under 35 U.S.C. 154(b) by 203 days.

(21) Appl. No.: 10/753,468

(22) Filed: Jan. 9, 2004

(65) Prior Publication Data

US 2005/0152570 A1 Jul. 14, 2005

(51) Int. Cl.
*H04R 1/20* (2006.01)
*H04R 1/02* (2006.01)
*H04R 7/00* (2006.01)

(52) U.S. Cl. ..... 381/353; 381/354; 381/413; 181/172

(58) Field of Classification Search ..... 381/348, 381/353, 354, 386, 392, 398, 413; 181/146, 181/151, 160, 171, 172
See application file for complete search history.

(56) References Cited

U.S. PATENT DOCUMENTS 3,275,100 A * 9/1966 Dunning ..... 381/348
4,797,935 A * 1/1989 Tanaka ..... 381/392

* cited by examiner

*Primary Examiner*—Sinh Tran
*Assistant Examiner*—Brian Ensey
(74) *Attorney, Agent, or Firm*—Alan D. Kamrath; Nikolai & Mersereau, P.A.

(57) ABSTRACT

An anti-resonant structure for speakers includes a resonant structure which has a housing compartment, at least one elastic element located in the housing compartment that has one end fastening to the resonant structure and another end coupling with a speaker, and at least one buffer element located between the resonant structure and the elastic element to serve as a buffer interface to prevent the speaker from hitting due to elastic element and the resonant structure. The speaker is the element that generates vibration. The elastic element has an elastic section to absorb the vibration energy generated by the speaker to prevent the resonant structure from generating unwanted resonance and noises, and prevent electronic elements from being damaged by the resonant effect.

7 Claims, 4 Drawing Sheets

ANTI-RESONANT STRUCTURE FOR SPEAKERS

BACKGROUND OF THE INVENTION

Field of the Invention

The present invention relates to an anti-resonant structure for speakers that prevents direct contact of a speaker and a resonant structure through an elastic element, and has a buffer structure interposed between the elastic element and the resonant structure to form a loose contact therebetween so that the buffer element can absorb the vibration energy generated by the speaker and provide an inherent damping effect to eliminate the vibration energy thereby to reduce the resonant energy generated by the speaker and maintain the acoustic quality output by the speaker and reduce damages of electronic elements in the resonant structure.

Music has almost become one of indispensable leisure activities in people's life nowadays. There are many ways to generate music, such as playing guitar or singing. With advances of technologies, now music can be transformed to electronic signals and transferred to a speaker through electronic elements in an audio system. The speaker has a film. When the electronic elements transfer an electronic signal to the speaker of the audio system, the speaker transforms the electronic signal and generates a magnetic field to drive the film of the speaker to vibrate. The repetitive to and fro vibrations of the film disturbs the surrounding air and transforms the electronic signal to sound again. Then a resonant structure is used to produce to and fro vibrations from the sound generated by the film of the speaker to achieve a resonant effect so that the sound is louder and may be broadcast to a longer distance.

Initially an audio system mainly consists of a resonant structure and a speaker and related electronic elements. As previously discussed, the speaker receives electronic signals and the film vibrates to disturb the surrounding air to generate sound wave energy. A portion of the sound wave energy directly transmits outwards. The rest sound wave energy is coupled with the resonant structure to generate resonant effect. According to Newton's third kinetic law: action force equals to reaction force. The repetitive vibration of the speaker film gives the surrounding air an action force. And the surrounding air gives the speaker a reaction force. Hence the speaker also has repetitive movements. As a result, the speaker generates vibration energy. Since a conventional speaker is directly fastened to the resonant structure, the vibration energy resulting from the reaction of the speaker directly hits the resonant structure. Hence users often hear some unwanted hitting noises during listening music. As a result, music quality suffers.

To remedy the foregoing problems, some vendors provide a soft buffer element between the speaker and the resonant structure, such as rubber pad, sponge pad or other soft material that have damping effect to prevent the speaker in direct contact with the resonant structure so that the vibration generated by the speaker does not directly hit the resonant structure. In the past designs, the vibration energy generated by the speaker is absorbed by the buffer element. As the buffer element is made from a soft material, it is compressed under the vibration of the speaker, and the buffer element receives the vibration energy and deforms to prevent the speaker from hitting the resonant structure. The vibration energy absorbed by the buffer element is released only when the buffer element is not being compressed by the speaker. And the buffer element will return to its original form. Theoretically, the buffer element between the speaker and the resonant structure can prevent the direct contact of the speaker and the resonant structure, and eliminate the noise resulting from the speaker hitting the resonant structure. However it is not so in practice. While the speaker may be prevented from in direct contact with the resonant structure with the buffer element interposed therebetween, the speaker still has to be fastened securely in the resonant structure to avoid loosening and generating even louder noise. Hence the buffer element is tightly compressed. As a result, it loses its original characteristics of being compressible and deformed to absorb vibration energy. Since the vibration energy cannot be absorbed and consumed by the buffer element, the vibration energy is transferred from the buffer element to the resonant structure. Hence the problem of noise still exists.

SUMMARY OF THE INVENTION

Therefore the primary object of the invention is to provide a buffer element which is not fixedly fastened to the elastic element as the conventional techniques do and is not completely compressed so that it can absorb vibration energy and be deformed, and achieve the original damping effect.

The second object of the invention is to provide an elastic element and a buffer element to prevent the speaker from in contact with the resonant structure to overcome the problem occurred to the conventional techniques resulting from the speaker being directly fastened to the resonant structure or having a buffer element interposed between the speaker and the resonant structure.

Yet another object of the invention is to prevent the vibration energy generated by the speaker during operation from directly transferring to the resonant structure, and the generated vibration energy is absorbed by the elastic element and buffer element in a deformation fashion, and maintain an anchor condition with dynamic balance and stability to achieve a high quality acoustic effect and prevent noise interference resulting from the surrounding environment.

The anti-resonant structure for speakers according to the invention mainly includes a resonant structure, an elastic element and a buffer element. The resonant structure has a housing compartment and at least one first opening. The elastic element is located in the housing compartment of the resonant structure and has one end fastened to the resonant structure and another end abutting the first opening that has a second opening. The buffer element is located between the resonant structure and the elastic element to prevent the another end of elastic element where the second opening is located to be in direct contact with the resonant structure to serve as a buffer interface. The buffer element further has a third opening. The first, second and third openings are aligned on the same axis after assembly. The elastic element prevents the speaker and resonant structure and buffer element from in direct contact or forming a fixed fastening. Thus the elastic element and the buffer element provide vibration prevention for the entire body to prevent the electronic elements located in the housing compartment from being damaged and reduce the noises caused by hitting.

The foregoing, as well as additional objects, features and advantages of the invention will be more readily apparent from the following detailed description, which proceeds with reference to the accompanying drawings.

DESCRIPTION OF THE PREFERRED EMBODIMENTS

Figure 1A:
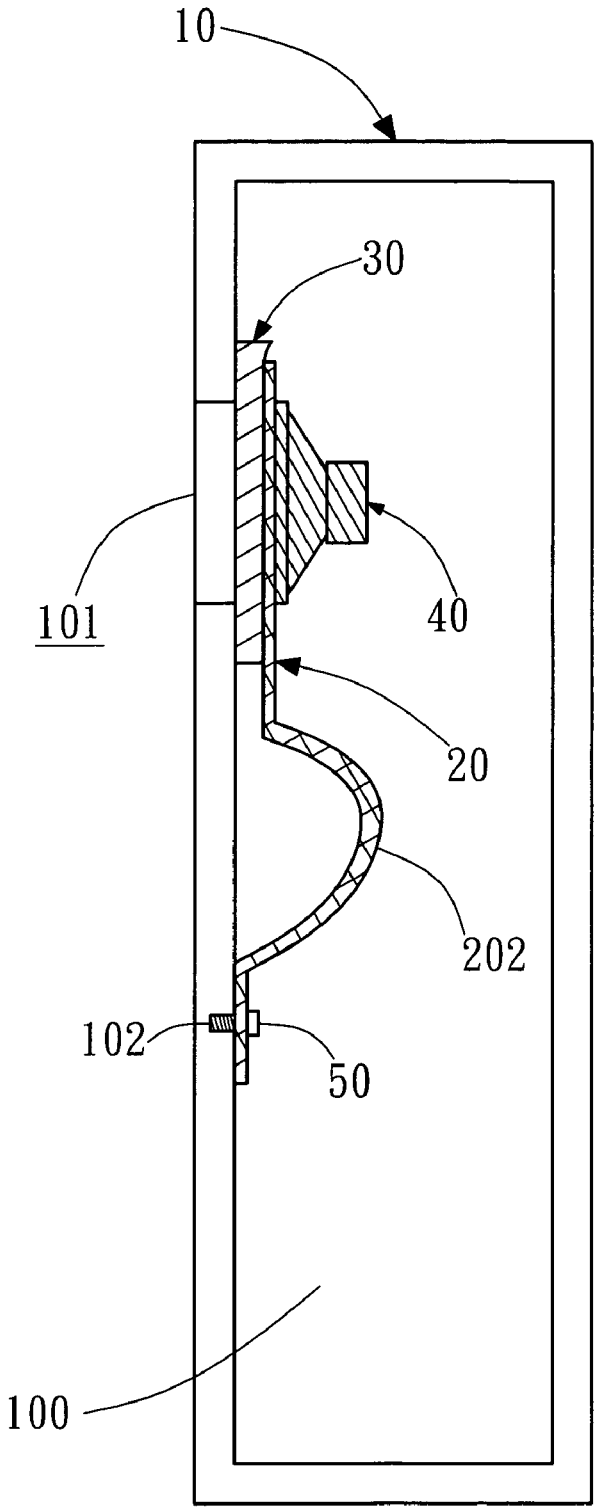
FIG. 1A is an exploded view of the invention without a resonant structure.
Figure 1B:
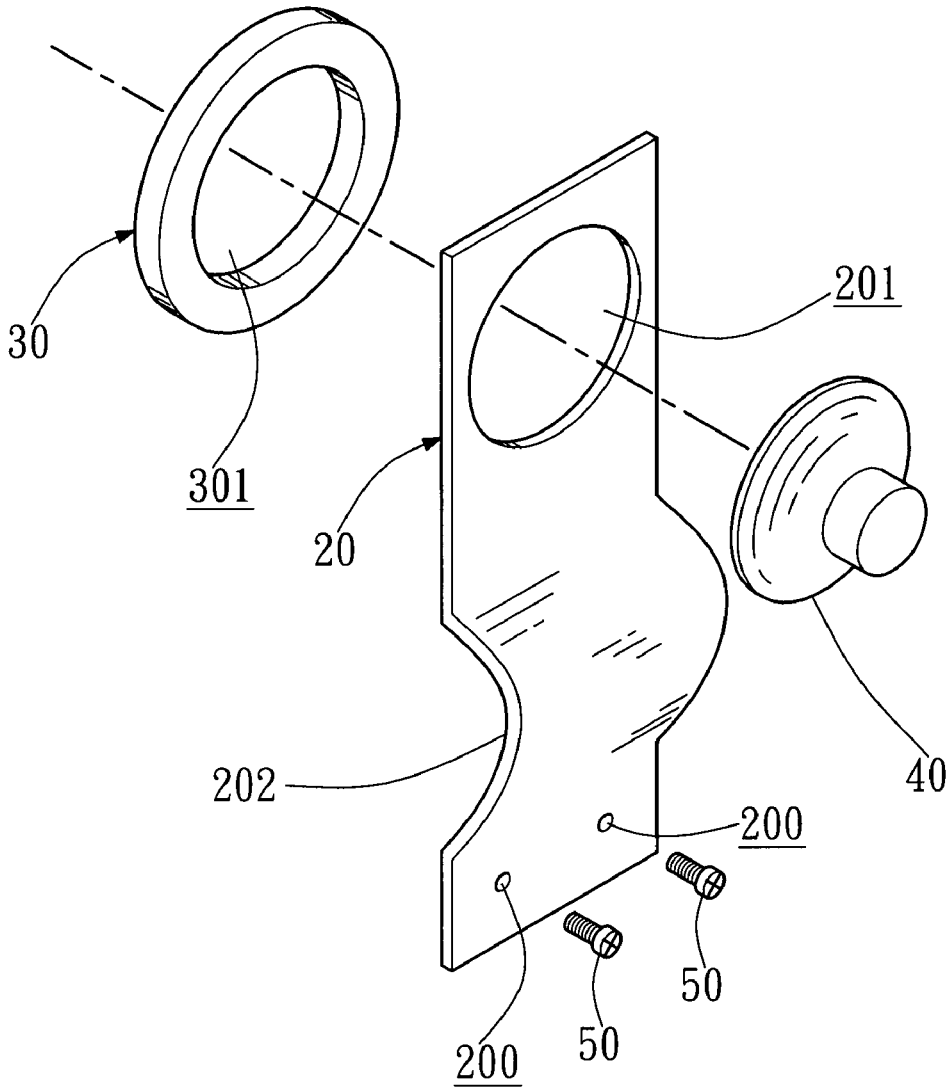
FIG. 1B is a side view of the invention including a resonant structure and with the elastic element not subject to a force.

Refer to FIGS. 1A and 1B for a first embodiment of the invention. The invention mainly includes a resonant structure 10 formed by a hollow object which has a housing compartment 100 for holding other elements and allowing sound waves to vibrate to and fro inside to generate resonant effect and produce a louder and higher quality sound. The resonant structure 10 has a first opening 101. There is an elastic element 20 located in the housing compartment 100. The elastic element 20 has two fastening apertures 200 corresponding to two cavities 102 formed on the resonant structure 10 for receiving two screws 50 to fasten the elastic element 20 to the resonant structure 10 with the cavities 102, apertures 200 and screws 50 aligned on the same axis. The elastic element 20 has a second opening 201 abutting the first opening 101, and an arched elastic section 202 in the middle portion. The elastic section 202 will be deformed when the elastic element 20 is subject to a force. When the force is released, the elastic element returns to its original form. A buffer element 30 is provided between the resonant structure 10 and the elastic element 20 to prevent the one end of the elastic element 20 where the second opening 201 is located in direct contact with the resonant structure 10 so that it serves as a buffer interface to prevent the elastic element from directly hitting the resonant structure when subject to an external force. The buffer element has a third opening 301. The first opening 101, second opening 201 and third opening 301 are aligned on the same axis. A speaker 40 is provided and fastened to the elastic element 20 on the second opening 201. When the speaker 40 is activated and generates sound, the sound is broadcast through the first opening 101 of the resonant structure 10, the second opening 201 of the elastic element 20 and the third opening 301 of the buffer element 30. Consequently, the elastic element 20 receives the vibration energy generated by the speaker and deforms.

Figure 1C:
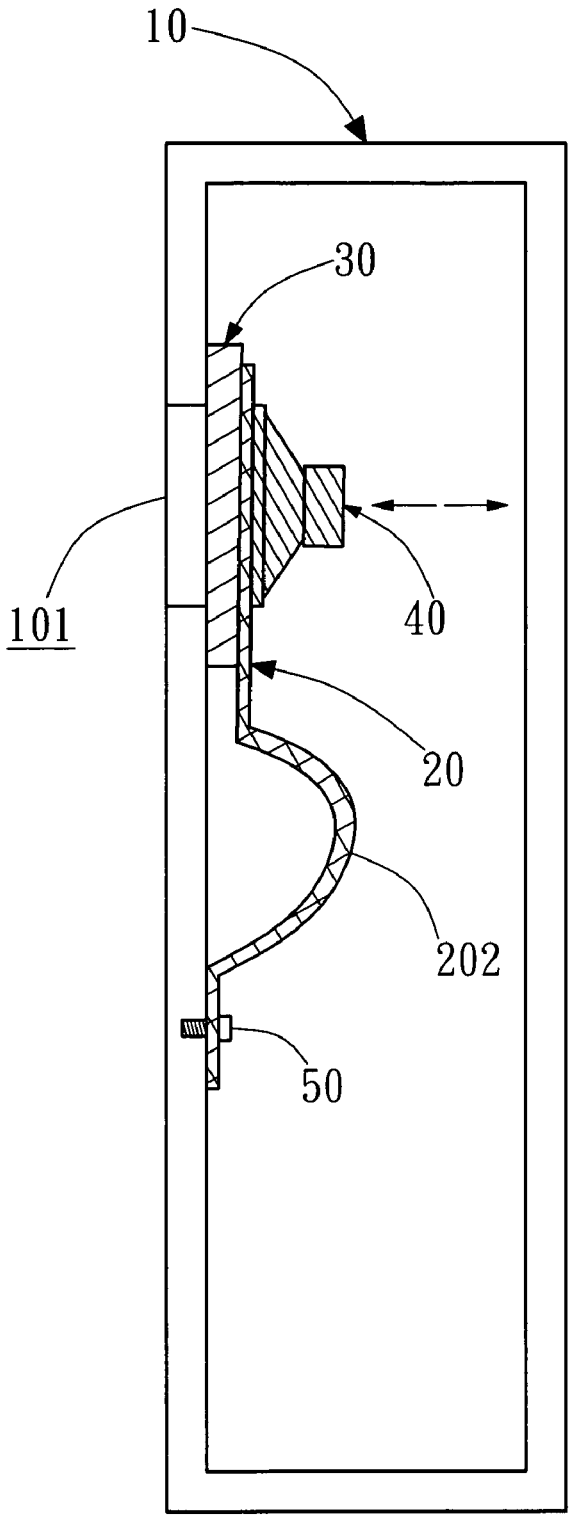
FIG. 1C is a side view of the invention including a resonant structure and with the elastic element subject to a force.

Refer to FIG. 1C for a side view of the first embodiment of the invention. When the speaker 40 starts operation and generates acoustic vibration energy, as the speaker 40 is fastened to the elastic element 20, the operation of the speaker 40 will cause the elastic element 20 to generate an oscillation of a small angle. The oscillation angle is small, hence the speaker 40 moves almost linearly. The vibration energy is transferred to the arched elastic section 202 which receives the vibration energy and deforms to consume the energy transferred from the speaker 40. Therefore the vibration energy is not transferred to the resonant structure 10. The screws 50 may be maintained tightly without loosening. And hitting may be avoided, and noise is not generated. In the invention, the buffer element 30 and the elastic element 20 are not fixedly coupled together. Instead, the elastic element 20 merely presses the buffer element 30. Hence the buffer element 30 is not compressed and can maintain the original damping function. When the elastic element 20 is driven by the resonant energy generated by the speaker 40, the elastic element 20 is also driven to hit the resonant structure 10. However, before hitting the resonant structure 10, the hitting energy is absorbed by the buffer element 30 located between the resonant structure 10 and the elastic element 20. The buffer element 30 as well as the elastic section 202 of the elastic element 20 will incur deformation to consume the hitting energy originated from the speaker 40 that has been transferred to the elastic element 20. Hence the elastic element 20 does not directly hit the resonant structure 10, and no hitting noise is generated.

Figure 2:
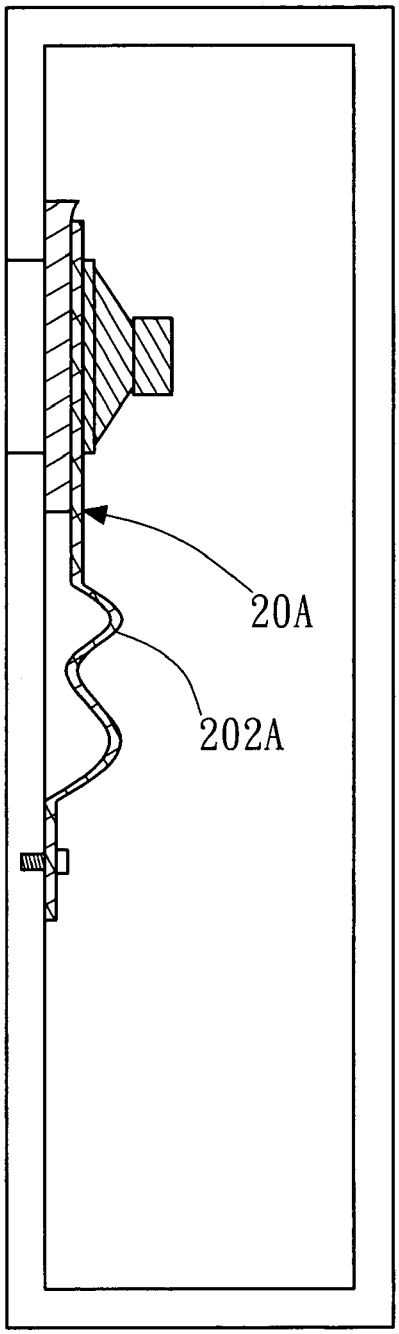
FIG. 2 is a schematic view of another embodiment of the invention.

Refer to FIG. 2 for another embodiment of the invention. It is substantially constructed like the one depicted before and provides the same function. The main difference is that the elastic element 20A of this embodiment has an undulate elastic section 202A to provide buffer function. It also can be deformed to consume vibration energy. The elastic section 202A may be formed in any other shape desired.

Figure 3:
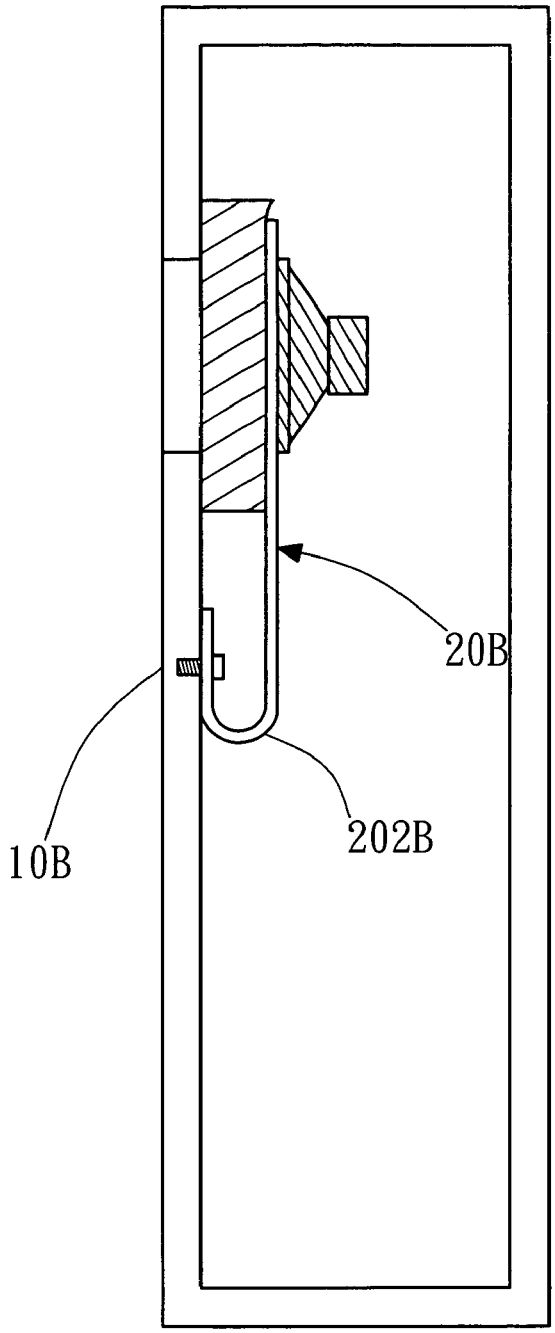
FIG. 3 is a schematic view of yet another embodiment of the invention.

Refer to FIG. 3 for yet another embodiment of the invention. It also is substantially constructed like the ones depicted before and provides the same function. The main difference is that the elastic section 202B of this embodiment has a bent section to form a U-shape which also can provide buffer function to consume vibration energy. Of course, the elastic section 202B may also be formed in any other shape desired.

In summary, the present invention has the following features:

1. The speaker is fastened to one end of the elastic element. The elastic element has another end fastened to the resonant structure, so that the speaker is prevented from in direct contact with the resonant structure.
2. The elastic element and the buffer element are not fixedly coupled. The elastic element merely presses the buffer element. Hence the buffer element does not have excessive compression from the elastic element and can provide the original damping effect.
3. In static conditions, the elastic element and the buffer element prevent the speaker in direct contact with the resonant structure, and provide a balanced and steady holding.
4. In dynamic conditions, the speaker operates and generates vibrations which are absorbed by the elastic element and buffer element. The balanced and steady dynamic fastening condition is maintained all the time. Thus the speaker can generate high quality acoustic effect and prevent the interference of excessive noises from the surrounding.

Thus the anti-resonant structure for speakers according to the invention provides an elastic element to prevent the speaker from in direct contact with the resonant structure, and the elastic element has an elastic section to absorb the resonant energy generated by the speaker, and a buffer element is provided to offer damping effect. Therefore it can resolve the problems occurred to the conventional techniques and provide a great improvement.

While the preferred embodiments of the invention have been set forth for the purpose of disclosure, modifications of the disclosed embodiments of the invention as well as other embodiments thereof may occur to those skilled in the art.

Accordingly, the appended claims are intended to cover all embodiments which do not depart from the spirit and scope of the invention.

What is claimed is:

1. An anti-resonant structure for speakers, comprising:

a resonant structure having a housing compartment and at least one first opening;

at least one elastic element located in the housing compartment having one end fastening to the resonant structure and another end abutting the first opening, the another end having a second opening; and at least one buffer element located between the resonant structure and the elastic element to serve as a buffer interface to prevent the elastic element from in direct contact with the resonant structure having a third opening, the first opening, the second opening and the third opening being aligned on a same axis after having been assembled.

2. The anti-resonant structure for speakers of claim 1, wherein the elastic element has another side other than the one in contact with the buffer element fastening to a speaker.

3. The anti-resonant structure for speakers of claim 1, wherein the elastic element is formed in a plate.

4. The anti-resonant structure for speakers of claim 3, wherein the elastic element has an elastic section to allow the elastic element to provide damping function.

5. The anti-resonant structure for speakers of claim 4, wherein the elastic section is formed in an arched shape.

6. The anti-resonant structure for speakers of claim 4, wherein the elastic section is formed in an undulate shape.

7. The anti-resonant structure for speakers of claim 4, wherein the elastic section has at least one bent section.

* * * * *